US005975302A

United States Patent [19]

Young

[11] Patent Number: 5,975,302

[45] Date of Patent: Nov. 2, 1999

[54] DATA CARD DISPLAY PACKAGE AND METHOD FOR DISPLAYING A DATA CARD

[76] Inventor: Steven R. Young, 7667 Chalkstone Dr., Dallas, Tex. 75248

[21] Appl. No.: 08/986,444

[22] Filed: Dec. 8, 1997

[51] Int. Cl.[6] ..... B65D 73/00

[52] U.S. Cl. ..... 206/449; 206/39

[58] Field of Search ..... 235/379, 380, 235/440, 486, 487, 492; 206/39, 449, 736

[56] References Cited

U.S. PATENT DOCUMENTS

| | | | |
|---|---|---|---|
| 3,927,442 | 12/1975 | Foster | 206/39 |
| 4,700,840 | 10/1987 | Haddock | 206/39 |
| 4,711,347 | 12/1987 | Drexler et al. | 206/39 |
| 4,942,913 | 7/1990 | Musso | 206/39 |
| 5,015,830 | 5/1991 | Masuzawa et al. | 235/380 |
| 5,506,395 | 4/1996 | Eppley | 206/39 |
| 5,514,862 | 5/1996 | Salzano | 235/486 |
| 5,609,253 | 3/1997 | Goade, Sr. | 206/460 |
| 5,740,915 | 4/1998 | Williams | 206/39 |
| 5,760,381 | 6/1998 | Stich et al. | 235/380 |
| 5,791,474 | 8/1998 | Hansen | 206/449 |

*Primary Examiner*—Jim Foster
*Attorney, Agent, or Firm*—Jones, Day, Reavis & Pogue

[57] ABSTRACT

A data card display package and method for displaying a data card having coded data disposed thereon are provided. The data package comprises a front cover, a back cover, and a center layer attached to each other. The data card is associated with the center layer between front and back covers with the coded data concealed. The data card is selectively movable between a first position concealed by the front and back covers and a second position in which at least a portion of the data card is extended exterior of said front and back covers without exposing the coded data on the data card.

12 Claims, 1 Drawing Sheet

DATA CARD DISPLAY PACKAGE AND METHOD FOR DISPLAYING A DATA CARD

BACKGROUND OF THE INVENTION

1. Field of the Invention

The present invention relates generally to packaging and more particularly, but not by way of limitation, to an improved data card package for advertising a data card having coded data disposed thereon as well as a method of displaying the data card having coded data thereon.

2. Description of Related Art including Information Disclosed Under 37 CFR 1.97 and 1.98

The purchase and usage of data or information cards continue to increase to the point that the sale of data cards is a multibillion dollar industry. There are all different types of such cards. An example is a prepaid calling card that provides a set dollar amount of long distance telephone calls that can be made with the card. The account is accessed and debited by using an account number that is provided on the calling card.

Because the card has an account number thereon, and because the cards are becoming increasingly popular and are found at check-out stands, and found on display racks, for example, the cards have to be manufactured so as to prevent someone from accessing the account number without purchasing the card. To this end, the prior art has provided improved security packaging for displaying a data card having coded data disposed thereon at the point of purchase. It is necessary and desirable, however, to not only provide the adequate security but to provide an attractive package for merchandising the data cards.

U.S. Pat. No. 5,609,253 discloses a data package in which the data card is disposed on one side of the backing with the coded data positioned against the backing and the covering laminated to a portion of the backing and the data card so as to seal the data card between the covering and the backing and mask the coded data on the data card. This leads to the data card being exposed on the package under the thin laminated transparent covering and consumes advertising space.

In like manner as shown in FIG. 1, a prior art display package includes a package 10 having a prepaid card 12 attached thereto with a transparent thin laminated film 14 so that the bottom portion of the card that has a magnetic stripe 16 thereon extends below the package and can be accessed for activating the card. Some type of an orifice 18 is used for hanging the package on a display rack so that the advertising 20 can be seen. By enabling the prepaid card 12 to extend partially below the package 10, more advertising space 20 is provided. However, it does detract from the attractiveness of the package and could allow someone to lift up the card 12 from the backing 10 so as to attempt to see the PIN number of the card that is concealed thereunder.

SUMMARY OF THE INVENTION

Thus the present invention provides a data card display package that not only provides security for the card, but also provides a very attractive package for the card for merchandising purposes.

In this package, the data card is in a concealed position between front and back covers of the package. It typically has a magnetic stripe on one side thereof toward the bottom of the card that can be accessed to activate the card. The actual account number or PIN number (personal identification number) is concealed by the package so that it cannot be accessed visually.

When it is necessary to access the magnetic stripe on the data card with the present package, the card is simply moved from its concealed position to a second position in which at least a portion of the data card extends externally of the front and back covers without exposing the coded data thereon. The magnetic stripe can then be read by the magnetic stripe reader and the card sold at the point of purchase. To retrieve the card, the package must be destroyed. Thus, this package allows large front and back sides to have advertising thereon while concealing the card between the front and back covers. However, the card is readily accessible for purposes of reading the magnetic stripe to activate the card.

It is, therefore, an object of the present invention to provide a data card display package in which the card is movable from a first concealed position within and between front and back covers forming the package to a second partially exposed position in which the card can be activated by reading the magnetic stripe thereon.

It is still another object of the present invention to provide a data card display package in which the data card is selectively movable between a first position concealed by front and back covers and a second position in which at least a portion of the data card is extended externally of the front and back covers without exposing the coded data thereon.

It is also an object of the present invention to conceal a data card in a first position between front and back display covers forming a display package and enabling the concealed card to be selectively moved between a first position and a second position wherein a portion of the card extends from between the front and back covers without revealing the encoded data.

Thus the present invention relates to a data card display package comprising a front cover, a back cover, and a center layer attached to each other in a sandwich-like relationship, and a data card having coded data thereon and being associated with the center layer between the front and back covers, the data card being selectively movable between a first position concealed by the front and back covers and a second position in which at least a portion of the data card is extended externally of the front and back covers without exposing the coded data.

The invention also relates to a method of displaying a data card having coded data thereon comprising the steps of concealing the data card in a first position between front and back display covers forming a display package, and enabling the concealed card to be selectively moved between the first concealed position and a second position wherein a portion of the card extends from between the front and back covers without revealing the encoded data.

BRIEF DESCRIPTION OF THE DRAWINGS

These and other features of the present invention will be more fully disclosed when taken in conjunction with the following DETAILED DESCRIPTION OF THE INVENTION in which like numerals represent like elements and in which.

DETAILED DESCRIPTION OF THE INVENTION

Figure 1:
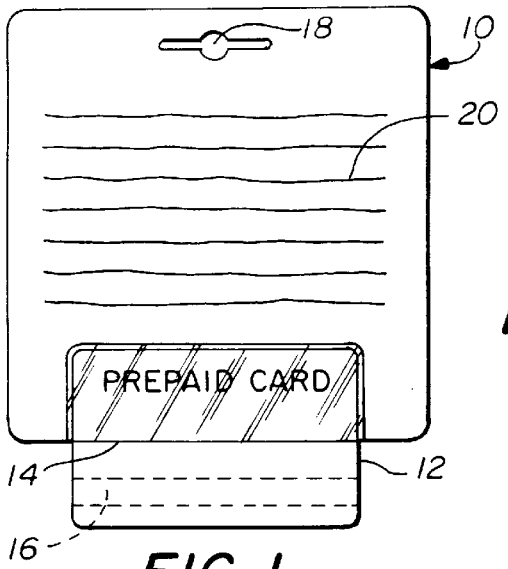
FIG. 1 PRIOR ART
FIG. 1 is a plan view of a prior art package for displaying a data card.
Figure 2:
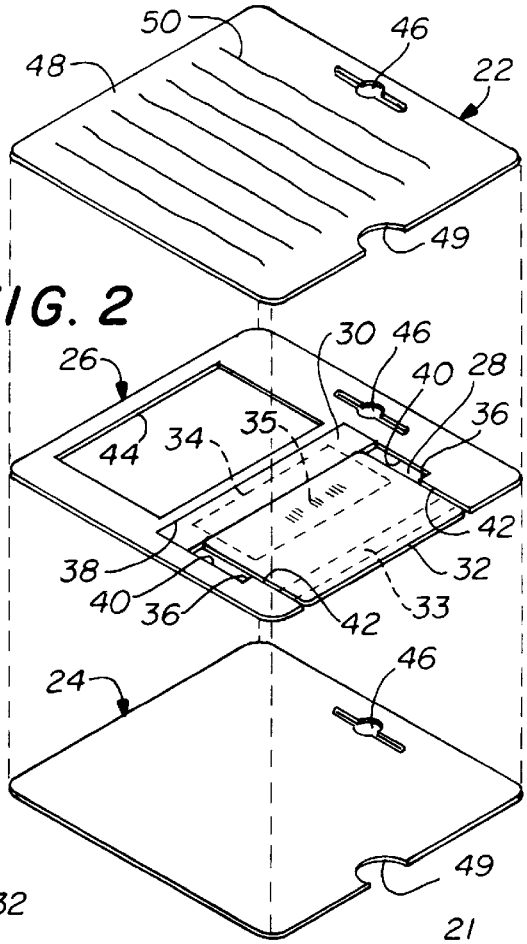
FIG. 2 is an exploded view of the display package of the present invention.
Figure 3A:
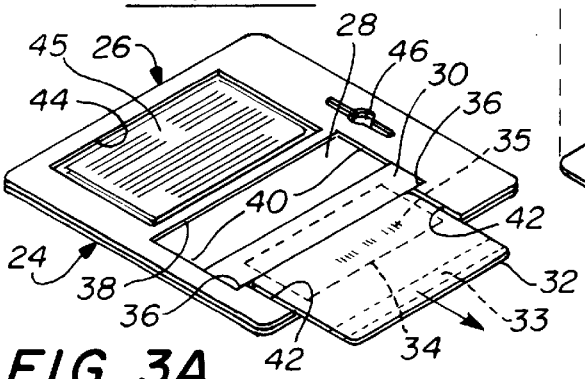
FIG. 3A is an isometric view of the center layer and back cover of the data card of FIG. 1 illustrating the display card attached to a panel movable within a compartment of the center layer to enable the data card to have a portion thereof extended from the display package.

FIG. 2 is an exploded view of the novel package of the present invention. The package 21 comprises a front cover 22, a back cover 24, and a center layer 26 attached to each other in a sandwich-like superimposed relationship in any well-known manner. A data card 32 having coded data 35 thereon is associated with the center layer 26 between the front and back covers 22 and 24, respectively. The data card 32 can be selectively moved between a first position concealed between the front and back covers 22 and 24 as shown in FIG. 2 and in FIG. 4 and a second position in which at least a portion of the data card 32 is extended externally of the front and back covers 22 and 24 without exposing the coded data as shown in FIG. 3A and FIG. 5.

Figure 4:
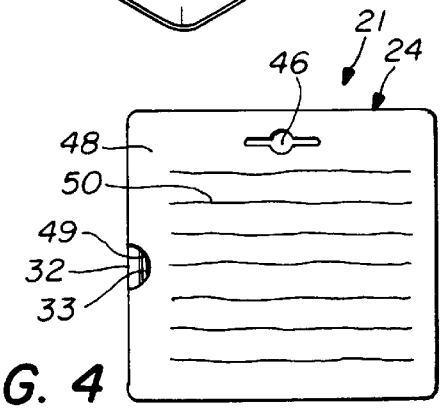
FIG. 4 is a plan view of the novel data card display package of the present invention with the data card concealed therein.
Figure 5:
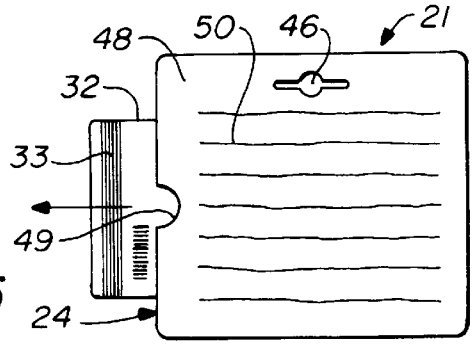
FIG. 5 is a plan view of the back side of the novel data card display package of the present invention with a portion of the data card extending from the display package to enable the magnetic stripe thereon to be accessed.

Opposing recesses 49 in both the front cover 22 and the back cover 24 expose a portion of the data card 32 in its first position as shown in FIG. 4 to assist in moving the data card 32 from its first concealed position shown in FIG. 4 to its second external position shown in FIG. 5.

Figure 3B:
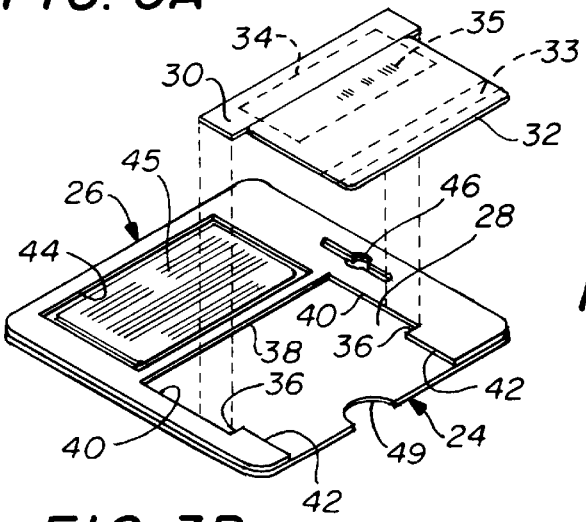
FIG. 3B is an exploded view of the panel and attached data card in relation to the center layer of the display package.

A compartment 28, shown best in FIG. 3B, is formed in the center layer 26 and has an inner wall 38, an outer wall 36, and opposing side walls 40. A panel 30 is located in the compartment 28 and is movable between said inner wall 38 as shown in FIG. 2 and said outer wall 36 as shown by the arrow in FIG. 3A. An opening formed by projections 42 in outer wall 36 extends externally of the center layer 26 and is of sufficient size to accept the data card 32 as shown in FIG. 2 and in FIG. 3A.

Attachment means 34 in the form of an adhesive tape or any other releasable fastening means removably attaches the data card 32 to the panel 30 in abutting relationship such that when the panel 30 is positioned adjacent the inner wall 38 of the compartment 28, the data card 32 is concealed by the front and back covers 22 and 24, respectively, and when the panel 30 is positioned adjacent the outer walls 36 of the compartment 28, the data card 32 has at least a portion thereon extending externally of the front and back covers 22 and 24 through the opening 42 as shown in FIG. 5.

The attachment means 34 may be any pliable material such as a tape having adhesive on one side thereof with the adhesively coated side extending across the abutting panel 30 and the data card 32 to cover the coded data 35 shown in FIG. 2 and in FIG. 3B and attaches the data card 32 to the panel 30. The data card 32 cannot be removed from the tape by pulling the data card parallel to the plane of the tape. Thus, the data card 32 cannot be removed from the package 21 simply by pulling on the data card. The package 21 has to be destroyed before the data card 32 can be removed from the tape or attachment means 34.

If desired, the package 21 can also include a second compartment 44 in the center layer for receiving additional material 45 as shown in FIG. 3A and FIG. 3B such as instructions on how to use the data card. The data card 32 has a magnetic stripe 33 on one side thereof as shown in FIG. 3A and FIG. 5 that is exposed in the second position of the card when a portion of it is external to the package as shown in FIG. 5 to allow the magnetic strip to be accessed for magnetic reading.

As can be seen in FIGS. 4 and 5, the recesses 49 in opposing front and back covers 22 and 24 allow the card 32 to be grasped so that the card can be pulled from its concealed position to its partially exposed position shown in FIG. 5. An opening or orifice 46 is formed in the front cover 22, the back cover 24, and the center layer 26 in juxtaposed relationship so that the display package can be hung on a rack for merchandising purposes.

Thus the method of displaying the data card 21 having the coded data thereon according to the present invention comprises the steps of concealing the data card 32 in a first position between front and back display covers 22 and 24, respectively, forming a display package 21 and enabling the data card 32 to be selectively moved between the first concealed position and a second position wherein a portion of the card extends from between the front and back covers 22 and 24 without revealing the encoded data 35.

The method further includes the steps of having a center layer 26 in the display package 21 between the front and back covers 22 and 24, providing a compartment 28 in the center layer 26 that has an inner wall 38, an outer wall 36, and opposing side walls 40 with an opening 42 in the outer wall 36 extending externally of the center layer 26, and removably attaching the data card 32 to a panel 30 in the compartment 28 that is movable between a first position adjacent the inner wall 38 and a second position adjacent the outer wall 36 such that the data card 32 can be selectively moved with the panel 30 between the first position to the second position to cause the data card 32 to be concealed between the front and back covers 22 and 24 in the first position and partially exposed in the opening 42 in the second position without revealing the coded data 35.

The method further includes the step of exposing a magnetic strip 33 on the data card 32 to access when the data card 32 is partially exposed through the opening 42.

Finally, the method includes the step of forming opposing recesses 49 in the front and back display covers 22 and 24 to expose a portion of the data card 32 in its first concealed position to enable the data card 32 to be manually moved to its second extended position.

Thus there has been disclosed a novel data card display package that conceals the data card in a first position allowing the full surface of the package to be used for advertising and enabling the card to be moved to a second position partially external of the package so that the magnetic strip thereon can be accessed. Thus the package not only conceals the data card with its PIN number but also allows full advertising space on the package while still enabling the card to be partially removed from its concealed location to enable the magnetic stripe to be accessed without exposing the written PIN number.

The corresponding structures, materials, acts, and equivalents of all means or step plus function elements in the claims below are intended to include any structure, material, or act for performing the function in combination with other claimed elements as specifically claimed.

I claim:

1. A data card display package comprising:

a front cover, a back cover, and a center layer attached to each other in superimposed relationship;

a compartment in said center layer having an inner wall, an outer wall, and opposing side walls;

a panel located in said compartment and adapted to be movable between said inner wall and said outer wall;

an opening in said outer wall extending to the exterior of said center layer, said opening being of sufficient size to accept a data card;

a data card having coded data thereon and being associated with said center layer between said front and back covers in a manner so as to be selectively movable between a first position substantially concealed by said front and back covers such that at least one of said front and back covers define an access area of said data card sufficient to allow said card to be grasped and manually moved from said first position to a second position in which at least a portion of said data card is extended externally of the front and back covers to allow use of said card without exposing said coded data; and attachment means for removably attaching said data card to said panel in abutting relationship such that, when the panel is positioned adjacent said inner wall of said compartment, said data card is in said substantially concealed position, and when the panel is positioned adjacent said outer wall of said compartment, said data card is in said second position.

2. The data card display package of claim 1 wherein said access area comprises:

opposing recesses in said front cover and said back cover to expose a portion of said data cad in its first position to enable said data card to be manually moved from its first concealed position to its second external position.

3. The data card display package of claim 1 wherein the attachment means comprises:

a pliable material having an adhesively coated side; and said adhesively coated side of said pliable material extending across said abutting panel and data card to cover said coded data on said data card and to attach said data card to said panel.

4. The data card display package of claim 1 further including a second compartment in said center layer for receiving material.

5. The data card display package of claim 1 further including a magnetic stripe on said card that is exposed in said second position of said card to allow said magnetic stripe to be accessed for magnetic reading.

6. A method of displaying a data card having coded data thereon comprising the steps of:

concealing said data card in a first position between front and back display covers forming a display package;

including a center layer in said display package between said front and back covers;

providing a compartment in said center layer having an inner wall, an outer wall, and opposing side walls with an opening in said outer wall extending to the exterior of said center layer;

removably attaching said data card to a panel in said compartment that is movable between a first position adjacent said inner wall and a second position adjacent said outer wall; and enabling said concealed card to be selectively moved between the first concealed position and a second position wherein a portion of said card extends from between said front and back covers without revealing said coded data.

7. The method of claim 6 further including the step of exposing a magnetic stripe on said data card to access when said data card is partially exposed through said opening.

8. The method of claim 6 further including the step of forming opposing recesses in said front and back display covers to expose a portion of said data card in its first concealed position to enable said data card to be manually moved to its second extended position.

9. A data card display package comprising:

a front cover, a back cover, and a center layer attached to each other in superimposed relationship;

a compartment defined in said center layer having an outer wall;

a panel located in said compartment in a manner so as to be selectably movable between a first position and a second position, said outer wall of said center layer determining said second position by preventing further movement of said panel; and a data card having coded data thereon and being removeably attached to said panel in a manner so as to be selectively movable between said first position such that said data card is substantially concealed by said front and back covers such that at least one of said front and back covers define an access area on said data card sufficient to allow said card to be grasped and manually moved from said first position to said second position such that a portion of said data card sufficient to allow use of said card is extended externally of the front and back covers without exposing said coded data.

10. The data display package of claim 9 wherein said access area comprises:

opposing recesses in said front cover and said back cover to expose said sufficient portion of said data card in its first position to enable said data card to be grasped and manually moved from its first concealed position to its second external position.

11. A method of displaying a data card having coded data thereon comprising steps of concealing said data card in a first position in a compartment between front and back display covers forming a display package, said compartment having an outer wall with an opening extending to the exterior of said front and back display cover;

removably attaching said data card to a panel in said compartment that is movable between said first position and a second position; and enabling said concealed card to be selectively moved between said first concealed position and said second position wherein a portion of said card extends from between said front and back covers without revealing said coded data.

12. The method of claim 11 further including the step of exposing a magnetic stripe on said data card to access when said data card is partially exposed through said opening.

* * * * *

UNITED STATES PATENT AND TRADEMARK OFFICE

CERTIFICATE OF CORRECTION

PATENT NO. : 5,975,302
DATED : Nov. 2, 1999
INVENTOR(S) : Young

It is certified that error appears in the above-identified patent and that said Letters Patent is hereby corrected as shown below:

Column 5, line 28, "cad" should read -- card --.

Column 6, line 43, after "steps of", insert -- : --.

Signed and Sealed this

First Day of August, 2000

*Attest:*

Q. TODD DICKINSON

*Attesting Officer*

*Director of Patents and Trademarks*